US009125437B2

(12) United States Patent
Kaljura

(10) Patent No.: US 9,125,437 B2
(45) Date of Patent: Sep. 8, 2015

(54) SMOKING ARTICLES AND METHODS OF MANUFACTURING THE SAME

(71) Applicant: BRITISH AMERICAN TOBACCO (INVESTMENTS) LIMITED, London (GB)

(72) Inventor: Karl Kaljura, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 14/347,238

(22) PCT Filed: Sep. 25, 2012

(86) PCT No.: PCT/GB2012/052371
§ 371 (c)(1),
(2) Date: Mar. 25, 2014

(87) PCT Pub. No.: WO2013/045912
PCT Pub. Date: Apr. 4, 2013

(65) Prior Publication Data

US 2014/0238426 A1 Aug. 28, 2014

(30) Foreign Application Priority Data

Sep. 26, 2011 (GB) ..... 1116541.2

(51) Int. Cl.
*A24D 3/04* (2006.01)
*A24D 3/02* (2006.01)

(52) U.S. Cl.
CPC ..... *A24D 3/041* (2013.01); *A24D 3/0275* (2013.01); *A24D 3/043* (2013.01)

(58) Field of Classification Search
CPC ..... A24D 3/041; A24D 3/043; A24D 3/0275
USPC ..... 131/331, 336
See application file for complete search history.

(56) References Cited

U.S. PATENT DOCUMENTS

| | | | |
|---|---|---|---|
| 2,954,035 | A | 9/1960 | Saffir |
| 3,376,874 | A | 4/1968 | Kim et al. |
| 4,273,141 | A | 6/1981 | Van Tilburg |
| 4,699,158 | A | 10/1987 | Sprinkel, Jr. |
| 4,700,725 | A | 10/1987 | Geiszler |
| 4,718,437 | A | 1/1988 | Luke |
| 4,809,718 | A | 3/1989 | Deal |
| 4,834,117 | A | 5/1989 | Braem et al. |
| 4,848,375 | A | 7/1989 | Patron et al. |

FOREIGN PATENT DOCUMENTS

| | | | |
|---|---|---|---|
| DE | 3516841 | A1 | 11/1986 |
| EP | 0228211 | A1 | 7/1987 |

(Continued)

OTHER PUBLICATIONS

International Search Report and Written Opinion, mailed Feb. 5, 2013 for PCT/GB2012/052371, filed Sep. 25, 2012.

(Continued)

*Primary Examiner* — Anthony Calandra
(74) *Attorney, Agent, or Firm* — N W Poulsen; L A Pinol

(57) ABSTRACT

A smoking article including: a first part defining a first end surface, and a second part defining a second end surface. The first part is rotatable relative to the second part. The first and second end surfaces are configured to engage to limit rotation between the first and second parts.

19 Claims, 2 Drawing Sheets

(56) References Cited

FOREIGN PATENT DOCUMENTS

| | | | |
|---|---|---|---|
| EP | 0260789 | A1 | 3/1988 |
| WO | 2009031038 | A2 | 3/2009 |
| WO | 2011051115 | A1 | 5/2011 |
| WO | 2011121328 | A2 | 10/2011 |

OTHER PUBLICATIONS

International Preliminary Report on Patentability, mailed Nov. 18, 2013, for PCT/GB2012/052371, filed Sep. 25, 2012.

SMOKING ARTICLES AND METHODS OF MANUFACTURING THE SAME

The present disclosure relates to smoking articles, filter assemblies for smoking articles, and methods of manufacturing smoking articles.

U.S. Pat. No. 4,700,725 describes a smoking article having a variable dilution, controlled by relatively rotatable filter segments. Spaced-apart stop elements are provided on one filter segment and a tongue-like engagement element is provided on the other filter segment. The edges of the engagement element engage the edges of the stop elements to limit rotation. The manufacture of this smoking article requires the formation of the stop elements and the engagement element.

The present disclosure provides, in a first aspect, a smoking article including a first part defining a first end surface, a second part defining a second end surface, wherein the first part is rotatable relative to the second part, and the first and second end surfaces are configured to engage to limit rotation between the first and second parts. In some aspects, the first and second parts are rotatable when the first and second end surfaces are separated longitudinally, and wherein engagement of the first and second end surfaces substantially prevents further rotation. In other aspects, the first and/or second parts define a longitudinal axis, and the first end surface and/or second end surface is/are angled to a lateral plane.

The present disclosure further provides, in a second aspect, a filter assembly for a smoking article, including a first part having a first filter section defining a first end surface, a second part having a second filter section defining a second end surface, wherein the first filter section is rotatable relative to the second filter section, and the first and second end surfaces are configured to engage to limit rotation between the first and second parts.

The present disclosure still further provides, in a third aspect, a method of manufacturing a smoking article including forming a first end surface on a first part, forming a second end surface on a second part, connecting the first and second parts such that the first part is rotatable relative to the second part, and the first and second end surfaces are engageable to limit rotation between the first and second parts.

Embodiments of the present invention will now be described, by way of example only, with reference to the accompanying drawings, in which.

Figure 1:
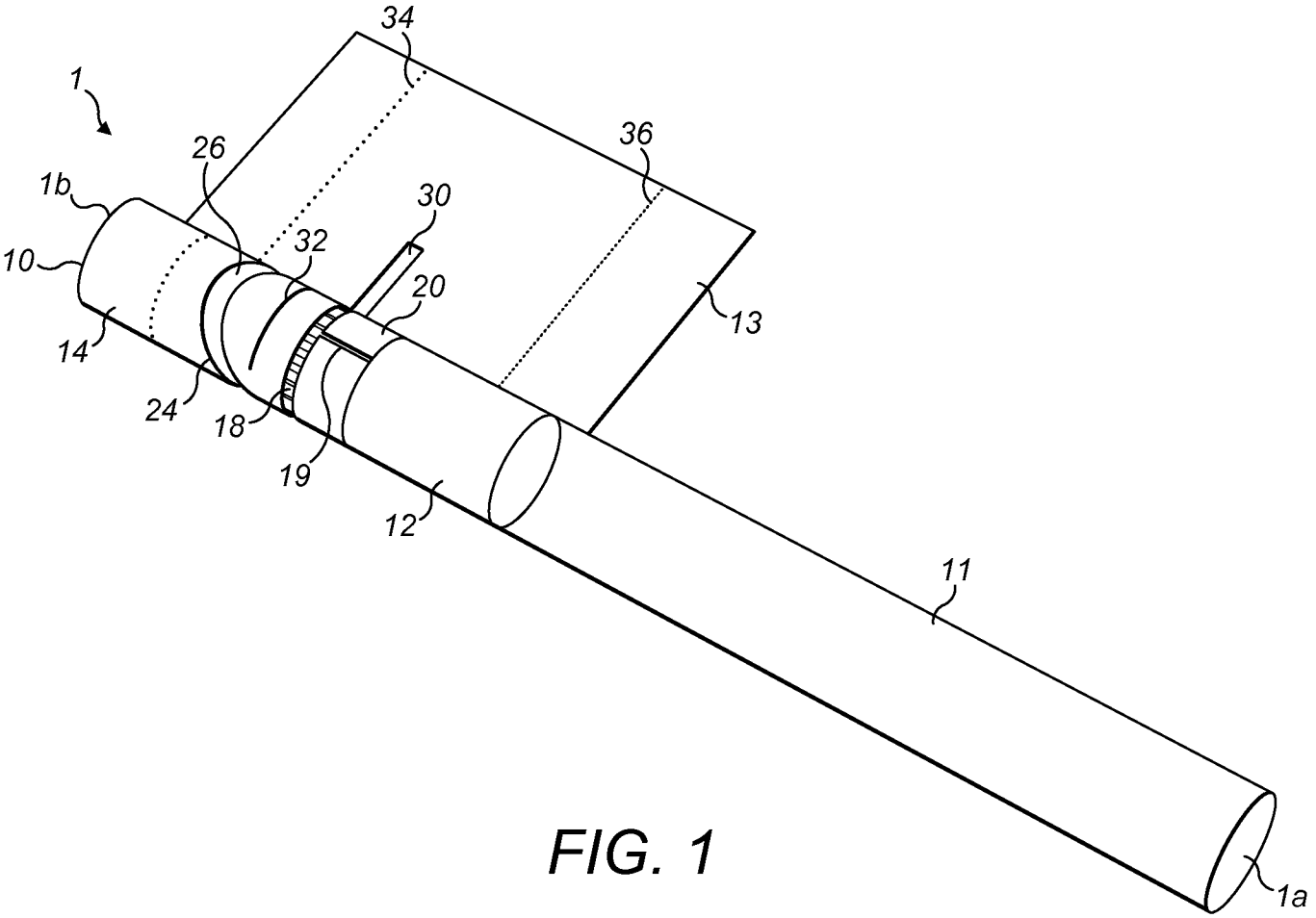
FIG. 1 is a perspective view of a smoking article in a partially formed state according to the present invention.
Figure 2:
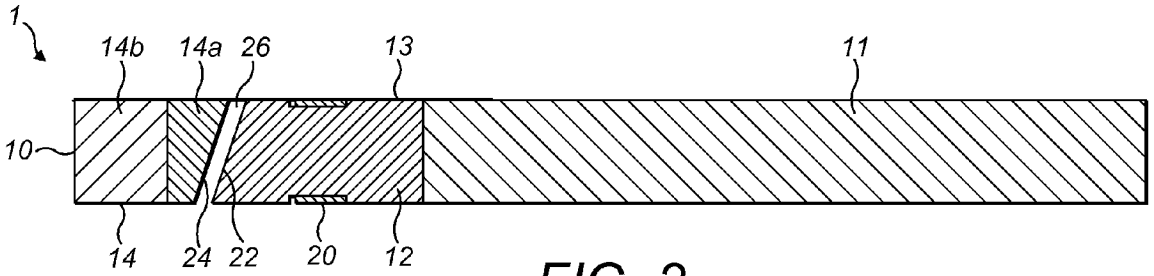
FIG. 2 is a cross-section view along line A-A in FIG. 3 of the partially formed smoking article as shown in FIG. 1.
Figure 3:
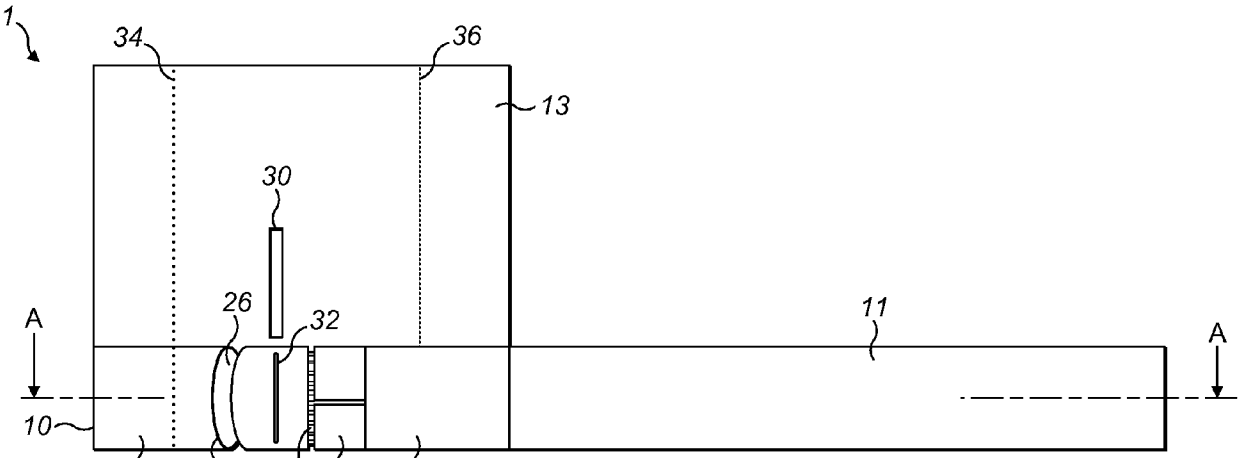
FIG. 3 is a side elevation view of the partially formed smoking article as shown in FIG. 1.

FIGS. 1 to 3 show a smoking article according to some embodiments of the disclosure. The smoking article may be an article such as a cigarette, cigar or cigarillo, whether based on tobacco, tobacco derivatives, expanded tobacco, reconstituted tobacco or tobacco substitutes and also heat-not-burn products (i.e. products in which flavour is generated from a smoking material by the application of heat without causing combustion of the material). For convenience, these will be referred to as "smoking articles" in this specification.

For purposes of illustration, and not limitation, as embodied herein and as illustrated in the Figures, an exemplary smoking article 1 includes a first part having a source of smokable material 11, which may be tobacco. The source of smokable material 11 is illustrated as being in the form of a tobacco rod. The smoking article 1 further includes a filter assembly 10 attached to the source of smokable material 11. The smoking article, as illustrated, includes a rotatable part that is rotatable to select a property of the smoking article, such as a ventilation level. The smoking article also includes a rotational limiter, configured to limit rotation within a pre-determined range. In some aspects, the filter assembly forms the rotational limiter.

In some embodiments, the filter assembly 10 includes a first filter section 12 and a second filter section 14. The first filter section 12 may be attached to the source of smokable material to form a single unit, or unitary assembly. The tobacco rod and first filter section 12 may be connected with a covering layer to affix the first filter section 12 to the tobacco rod, preferably formed of tipping paper as is conventionally known. The tobacco rod and first filter section may be referred to as a first part of the smoking article, or as a tobacco unit. The elongate tobacco rod and first filter section define a longitudinal axis of the smoking article.

As further illustrated, in some embodiments a second part of the smoking article includes the second filter section 14. The second filter section 14 is co-axial with respect to the first filter section 12, and is located rearwardly of the first filter section 12. The smoking article defines a rearward, proximal end, 1*b*, and a forward, distal, end 1*a*, wherein the proximal end 1*b* is the end that is closer to the user of the smoking article during use.

The second part of the smoking article further includes a sleeve 13 in the form of a cylindrical tube extending around the circumference of the tobacco rod 11 and/or first filter section 12. The material of the sleeve 13 is, in some implementations, substantially impermeable to air, and may be formed as a cylinder of paper. The tobacco rod and first filter section are dimensioned to rotate as a unit around a longitudinal axis within the sleeve 13. The second filter section 14 is at a mouthpiece end of the sleeve 13, adjacent to the first filter section 12. The second filter section 14 is securely attached and fixed within the sleeve. The first and/or second filter sections are preferably made of a conventional filtration material, e.g. cellulose acetate tow. The filtration material may be wrapped in a sheet material, preferably paper, e.g. plugwrap.

By way of further illustration, embodiments of the smoking article are provided with a ventilation system configured to allow adjustment of ventilation of the smoking article. The ventilation system may, in some implementations, include one or more ventilation areas, which in turn comprise, provide and/or define ventilation apertures or air permeable material, in one of or each of the first part and second part. For example, when ventilation areas in the sleeve and layers of sheet material around the first and/or second filter sections are aligned, air can flow into the body of the first and/or second filter section. The ventilation is selected by selecting a rotational position of the second part relative to the first part. The smoking article may further include a rotational limiter (limiting mechanism) configured to limit relative rotation between the first and second parts about the longitudinal axis of the smoking article. The rotational limiter may be configured to limit rotation to a pre-determined range. In some aspects, the pre-determined range of rotation may be through an angle of from about 90 to about 180 degrees in any desired angular increment, for example increments of five degrees, ten degrees or fifteen degrees, and may be, for example, be rotatable through approximately 120 degrees.

In various embodiments, the rotational limiter includes a first end surface 22 defined on the first part and a second end surface 24 on the second part. In some aspects, the first end surface 22 is an end surface of the first filter section 12, and/or the second end surface 24 is an end surface of the second filter section 14. The first and second end surfaces 22,24 are substantially longitudinally facing surfaces, forming longitudinal ends of the first and second filter sections 12,14. The first and second end surfaces 22,24 are facing surfaces of the first and second parts. The first and second end surfaces 22,24 are configured to limit rotation between the first and second parts. As illustrated, the first and second parts can be rotatable when the first and second end surfaces are separated longitudinally by a spacing 26. Contact or engagement of at least a portion of the first and second end surfaces 22, 24 restricts, and may substantially prevent, further rotation.

The first part is rotatable at a fixed longitudinal position relative to the second part. The smoking article may include a restraining mechanism to prevent relative longitudinal movement between the first and second parts. An exemplary embodiment of restraining mechanism is described below.

The first and second end surfaces 22, 24 are configured such that rotation whilst the first and second end surfaces 22, 24 are in contact does not substantially cause any longitudinal movement between the first and second parts. In some examples, adjacent material of the first part also forms the material of the first end surface, and/or adjacent material of the second part also forms the material of the second end surface. In some aspects, the first and second parts are formed of filtration material, such that the first and second end surfaces 22,24 are formed of filtration material. In some examples, when the first and second end surfaces are engaged, friction between the filtration material forming the first end surface 22 and the filtration material forming the second end surface 24 substantially prevents further rotation. The friction inhibits further rotation when only a part of the area of the first and second end surfaces are engaged.

The first and second sections of the filter may define a longitudinal axis. A lateral plane is defined as being perpendicular to the longitudinal axis. In some aspects, one or both of the first and second end surfaces are angled to a lateral plane, i.e. are not parallel to the lateral plane. In some aspects, the first and second end surfaces may extend at the same angle to a lateral plane. For example, the angle may between about 10 and 45 degrees. The angle may also between about 10 and 30 degrees, or between about 15 and 25 degrees, at any desired angle.

In some embodiments, in an initial state prior to rotation, the first end surface and second end surface extend parallel to one another. The first end surface and/or second end surface may be planar. In the initial state, the first and second end surfaces 22, 24 preferably extend parallel to one another and at a same angle with respect to a lateral plane.

In some embodiments, the first end surface and second end surface 22, 24 are initially separated by a longitudinal spacing 26 of from about 0.5 mm to about 2 mm. The longitudinal spacing may be 1 mm to 1.5 mm, or 1.2 mm to 1.6 mm, or greater than 0.5 mm, or may be approximately 1.4 mm. The longitudinal spacing may determine the rotational angle through which the first and second parts rotate before engaging. Thus, the longitudinal spacing 26 is a pre-determined and intentional spacing. The angle at which the end surfaces are inclined may also determine the rotational angle through which the first and second parts rotate before engaging. The first and second parts may be known to deform under strain when engaged, and the expected strain and deformation may be considered when determining the configuration of the smoking article to limit rotation to a pre-determined range.

The longitudinal spacing 26 between the first and second end surfaces may initially be uniform over the whole area of the first and second end surfaces. In some embodiments, the longitudinal spacing may be uniform when the first and second end surfaces are planar and extend at the same angle to a lateral plane, in the same orientation. As the first part is rotated relative to the second part, a longitudinal separation of a portion of the first end surface from the second end surface will be reduced.

As illustrated, the sleeve 13 is preferably affixed to the second part and extends around the first and second end surfaces. The sleeve 13 surrounds and covers the first and second end surfaces, and the longitudinal spacing 26 therebetween.

The sleeve 13 may be provided with one or more first ventilation area 30. In some examples, the sleeve 13 includes a single first ventilation aperture 30 extending circumferentially over a part only of the circumference, and preferably at a single longitudinal position. Preferably, the first ventilation aperture 30 is in the form of a narrow circumferential slit.

The tobacco unit 11,12 may include one or more second ventilation areas 32. In some embodiments, the tobacco unit 11,12 may include a single second ventilation aperture 32 extending circumferentially over only a part of the circumference, and preferably at a single longitudinal position. Preferably, the second ventilation aperture 32 is in the form of a narrow circumferential slit. The second ventilation aperture 32 allows ingress of air into the tobacco unit, for example, into the first filter section 12. The second ventilation aperture 32 is an aperture or air permeable area allowing air into the filtration material of the first filter section 12, through the layers of sheet material surrounding the filtration material.

Ventilation through the first and second ventilation areas 30,32 is dependent on alignment of the apertures, i.e. overlapping area, which is determined by the rotational position of the first part of the smoking article relative to the second part of the smoking article.

In some embodiments, the sleeve 13 may include one or more further ventilation areas 34. The ventilation area(s) 34 may provide ventilation which is independent of the rotational position of the position of the first and second parts of the smoking article. The further ventilation area(s) 34 may provide a base level, or minimum, ventilation to the smoking article. The ventilation area(s) 34 may allow air through the sleeve, and into the second filter section 14. The second filter section 14 may include filtration material surrounded by a porous paper wrap (e.g. plugwrap), or have ventilation areas matching the ventilation areas 34, which allows the ventilating air into the filtration material of the second filter section 14. The further ventilation area 34 may include a plurality of apertures 34 extending circumferentially in a line.

In some embodiments, the sleeve 13 may include a separation line 36, which extends substantially circumferentially. The sleeve is configured to easily break along the separation line 36 into a forward part and a rearward part. The rearward part is affixed to the second filter section 14. The forward part is affixed to the first filter section 12, for example, by adhesive. Optionally, the forward part of the sleeve 13 connects the tobacco rod 11 and first filter section 12. The separation line 36 may be defined by a plurality of perforations through the sheet material (e.g. paper) of the sleeve 13. In use, the forward and rearward parts of the sleeve are initially connected. The smoking article may have a defined initial ventilation, set by the ventilation areas 34, and a pre-determined initial alignment of the first and second ventilation areas 30,32. In some implementations, the sleeve is not readily rotatable (or slidable) relative to the tobacco unit. Application of a rotational force to the rearward part of the sleeve 13, relative to the tobacco unit, breaks the sleeve 13 along the separation line 36. The sleeve 13 is then rotatable to vary the ventilation by alignment of the first and second ventilation areas.

The ventilation areas in the sleeve and/or tobacco unit may be formed as apertures by a laser. For example, the laser may simultaneously generate aligned ventilation apertures in the sleeve and tobacco unit. Alternatively, the ventilation apertures may be formed as a slit by a mechanical cutting tool. In some implementations, the ventilation apertures may be formed as a cut-out area. In some implementations, the ventilation areas may be formed by an air permeable material, which is either manufactured as a permeable material or made permeable by the addition of apertures or by processing.

The position of the second part relative to the first part may be controlled by an indexing mechanism or indexer, configured to provide indexed rotation between a plurality of discrete positions. The indexer may optionally provide an audible sound, that is to say, emit an acoustic emission, indicating movement to or from the selected position. The indexer may include a first indexing section (or surface) 18 on the tobacco unit, for example, on the first filter section 12. The first indexing section is engaged with a second indexing section (or surface) 19 on the sleeve 13. The indexer provides a number of indexed positions, at least three, preferably at least five or seven within a limited range of rotation, e.g. 90 or 120 degrees.

In an exemplary indexer, the first indexing section 18 has a plurality of depressions or detents which are engageable by a protrusion on the second indexing section. The depressions/detents preferably form a corrugated exterior surface, including a plurality of elongate grooves, separated by ridges, which extend substantially or fully longitudinally, i.e., parallel to a central axis defined by the smokable element.

The second indexing section 19 may include one or more protrusions which are engageable with the first indexing section 18. The protrusion(s) may include one or more pawls, formed by one or more layers of sheet material which are folded to extend radially inwardly from the sleeve 13. The term "pawl" is intended to mean any type of protrusion which can engage with an indexing section to allow indexed movement in two directions. The pawl may be formed on a substrate 20, which may be a sheet material, for example, paper. The substrate may be affixed to an interior surface of the sleeve 13. The substrate may be folded to define the pawl as an upstanding ridge of sheet material, forming an edged peak. The pawl may have a substantially triangular cross-section. The indexer may be separate and distinct from the rotational limiter configured to limit the range of rotation between the first and second parts.

The smoking article may be configured to restrain the sleeve 13 from moving longitudinally over the tobacco unit. For example, the grooves, and optionally ridges, of the first indexing section 18 may have a radius which is less than forwardly and rearwardly adjacent parts of the first part. The second indexing section 19 is configured to engage with the forwardly and rearwardly adjacent parts, such that the second indexing section is retained longitudinally within the first indexing section. The first indexing section may have a longitudinal extent which is substantially the same as the second indexing section to prevent relative longitudinal movement between the first and second parts.

The first and/or second filter section may further include an adsorbent additive. In some examples, the adsorbent additive may be carbon, for example, charcoal and in particular, activated charcoal. Alternatively, the adsorbent additive may be a resin. The resin may be an ion exchange resin with a polyamine group as chelating ligand bonded onto a cross-linked polystyrene matrix, for example, Diaion® CR20. In some aspects, the adsorbent additive may be distributed within the filtration material of the first filter section 12. The adsorbent additive may be substantially uniformly distributed in the filtration material. The adsorbent additive may further be granules of carbon.

FIG. 1 shows the smoking article in a partially formed state. The sleeve 13 is a blank, which may be wrapped around the first and second filter sections 12,14 to form a cylinder. The first and second filter sections 12,14 are longitudinally spaced as the blank is wrapped around and affixed to the second filter section, second indexing section, and optionally, the first part forwardly of the separation line 36.

FIG. 2 shows the smoking article in an initial state. The first and second filter sections 12,14 are longitudinally separated by a uniform spacing 26. The first and/or second filter section 12,14 may include one or more filter elements. The filter elements may be separately formed sections of filter, which are co-axially connected. For example, the second filter section 14 may include a forward filter element 14*a* and a co-axial rearward filter element 14*b*. The forward filter element 14*a* may define the first end surface of the second filter section 14. The forward filter element 14*a* may originally be integrally formed with the first filter section 12, and separated by a single angled cut to form the first and second end surfaces 22,24. In some aspects, the forward filter element 14*a* may have different properties than the rearward filter element 14*b*. For example, the forward filter element 14*a* may include an adsorbent additive as set forth above, which may also be present in the first filter section 12. The rearward filter element 14*b* may or may not include an adsorbent additive.

The spacing or chamber 26 is surrounded by the sleeve 13. The smoking article is shown in a partially formed state, in which the sleeve 13 extends around only one side of the gap between the first and second end surfaces. During manufacture, the sleeve 13 may be rolled around the filter segments to form a cylinder extending around the whole circumference of the filter segments.

FIG. 3 shows a further view of the smoking article 1, as described above. The cross-section of FIG. 2 is taken through the line A-A.

In use, the first and second end surfaces are initially longitudinally separated by a pre-determined spacing 26. The first part may be rotated relative to the second part in a first rotational sense to a first maximum rotational position and in a second rotational sense to a second maximum rotational position. The range of rotation is defined by the angular rotational displacement between the first and second maximum rotational positions. The rotational position of the first part to the second part may determine the extent of ventilation of the smoking article.

Rotation of the first end surface relative to the second end surface results in a part of the second end surface 24 moving longitudinally towards the first end surface 22. The closest points between the first and second end surfaces reduce in separation until the first and second end surfaces are engaged, in embodiments where engagement is contemplated. The variation in separation is due to the relative rotation of the angled surfaces at fixed longitudinal positions. The engagement substantially inhibits any further rotation, and thus the first and second parts reach a maximum rotation.

Embodiments of the present disclosure may include a smoking article or a filter assembly for a smoking article. The filter assembly is attachable to a source of smokable material, optionally with further components, to form a smoking article having a rotational limiter as described. The filter assembly may include a first part including a first filter section defining a first end surface, and a second part including a second filter section defining a second end surface. The first filter section is rotatable relative to the second filter section, and the first and second end surfaces are configured to engage to limit rotation between the first and second parts.

The present disclosure further provides exemplary methods of manufacturing a smoking article. In one embodiment, the method includes forming a first end surface on a first part, and forming a second end surface on a second part. Optionally, the first end surface and the second end surface are formed with a single cut separating the first and second parts, in which the cut may be angled to a lateral plane. The first and second parts are connected such that the first part is rotatable relative to the second part, for example, with the sleeve surrounding at least a part of the first part. The first and second end surfaces are engageable to limit rotation between the first and second parts. The first and second ends are connected with a longitudinal separation.

The first and second end surfaces have been described as formed as end surfaces of a filter section. Alternatively, the first and/or second end surfaces may be formed by a material other than filtration material. For example, the tobacco rod may form an angled end surface, which is engageable with an end surface of a filter section, substantially as described above. Alternatively, one or both end surfaces may be formed on an insert of a different material.

The first and second end surfaces have been described as planar. Alternatively, one or both of the first and second end surfaces is not planar. For example, one or both of the first and second end surfaces may be stepped or curved.

The first and second end surfaces have been described as angled at the same angle to a lateral plane. Alternatively, the first and second end surfaces may extend at different angles to a lateral plane.

The first and second end surfaces have been described as parallel in an initial state. Alternatively, the first and second end surfaces may not be parallel in an initial state. In the initial state, the first and second end surfaces may be angled to each other. For example, the first and second end surfaces may be in contact initially, allowing initial rotation in only a single direction.

The first indexing section has been described as having a longitudinal extent which is substantially the same as the second indexing section to prevent relative longitudinal movement between the first and second parts. Alternatively, the first indexing section may have a longitudinal extent which is greater than the second indexing section, such that the indexing mechanism does not limit longitudinal movement. The smoking article may include further engaging surfaces to prevent longitudinal movement between the first and second parts.

Any of the features of any embodiment may be combined with any of the features of any other embodiment.

Embodiments of the disclosure are configured to comply with applicable laws and/or regulations, such as, by way of non-limiting example, regulations relating to emissions, constituents, testing, and/or the like. For example, selected embodiments may be configured such that a smoking article implementing aspects described herein is compliant with applicable regulations before and after adjustment by a user. Such implementations may be configured to be compliant with applicable regulations in all user-selectable positions. In some embodiments, the configuration is such that a smoking article implementing aspects described herein meets or exceeds required regulatory test(s) in all user-selectable positions, such as, by way of non-limiting example, the testing threshold(s)/ceiling(s) for cigarette emissions and/or smoke constituents.

The invention claimed is:

1. A smoking article having a longitudinal axis, the smoking article comprising:

a first part including a first filter section defining a first end surface, and a second part including a second filter section defining a second end surface, wherein, the first end surface and the second end surface are formed of filtration material, the first part is rotatable relative to the second part, the first part and the second part are rotatable when the first end surface and the second end surface are longitudinally separated, and the first end surface and the second end surface are configured to engage and limit rotation between the first part and the second part to within a pre-determined range.

2. The smoking article as claimed in claim 1, wherein engagement of the first end surface and the second end surface substantially prevents further rotation.

3. The smoking article as claimed in claim 1, wherein at least one of the first and the second part defines a longitudinal axis, and at least one of the first end surface and the second end surface is angled with respect to a lateral plane.

4. The smoking article as claimed in claim 1, wherein, in an initial state, the first end surface is substantially parallel to the second end surface.

5. The smoking article as claimed in claim 1, wherein the first end surface and the second end surface are planar.

6. The smoking article as claimed in claim 5, wherein, in an initial configuration, the first end surface is (1) substantially parallel to the second end surface, and (2) separated from the second end surface by a longitudinal spacing of from 0.5 mm to 2 mm.

7. The smoking article as claimed in claim 5, wherein, in an initial configuration, the first end surface is (1) substantially parallel to the second end surface, and (2) separated from the second end surface by a longitudinal spacing of from 1.2 mm to 1.6 mm.

8. The smoking article as claimed in claim 5, wherein, initial configuration, the first end surface is (1) substantially parallel to the second end surface and (2) separated from the second end surface by a longitudinal spacing of greater than 0.5 mm.

9. The smoking article as claimed in claim 5, wherein, in an initial configuration, the first end surface is (1) substantially parallel to the second end surface and (2) separated from the second end surface by a longitudinal spacing of from 1 mm to 1.5 mm.

10. The smoking article as claimed in claim 1, wherein the first part includes at least one first ventilation area, and the second part includes at least one second ventilation area, the smoking article configured such that relative rotation between the first part and the second part controls an overlapping area of the first ventilation area and the second ventilation area, determining a ventilation of the smoking article.

11. The smoking article as claimed in claim 1, wherein the second part includes a sleeve extending around the first end surface and the second end surface.

12. The smoking article as claimed in claim 1, further comprising an indexer configured such that rotation between the first part and the second part is indexed, wherein one of the first part and the second part includes at least one pawl configured to be received by a detent defined in the other of the first part and the second part.

13. The smoking article as claimed in claim 1, wherein the first end surface and the second end surface are configured such that rotation does not substantially cause any longitudinal movement between the first part and the second part.

14. A filter assembly for a smoking article, the filter assembly comprising:

a first part including a first filter section defining a first end surface, and a second part including a second filter section defining a second end surface, wherein the first end surface and the second end surface are formed of filtration material, the first filter section is rotatable relative to the second filter section, the first part and the second part are rotatable when the first end surface and the second end surface are longitudinally separated, and the first end surface and the second end surface are configured to engage and limit rotation between the first part and the second part to within a pre-determined range.

15. The filter assembly as claimed in claim 14, wherein engagement of the first end surface and the second end surface prevents further rotation.

16. The filter assembly as claimed in claim 14, wherein at least one of the first end surface and the second end surface is angled with respect to a lateral plane.

17. A method of manufacturing a smoking article, the method comprising:

forming a first end surface on a first part including a first filter section, forming a second end surface on a second part including a second filter section, the first end surface and the second end surface formed of filtration material, and connecting the first part and the second part such that the first part is rotatable relative to the second part, the first and second parts are rotatable when the first end surface and second end surface are longitudinally separated, and the first end surface and the second end surface are engageable to limit rotation between the first part and the second part to within a pre-determined range.

18. The method as claimed in claim 17, wherein the connecting comprises connecting the first, part and the second part, with the first end surface and the second end surface separated longitudinally.

19. The method as claimed in claim 17, wherein the first end surface and the second end surface are formed with a single cut separating the first part and the second part, and wherein the cut is angled with respect to a lateral plane.

* * * * *

UNITED STATES PATENT AND TRADEMARK OFFICE

CERTIFICATE OF CORRECTION

PATENT NO. : 9,125,437 B2
APPLICATION NO. : 14/347238
DATED : September 8, 2015
INVENTOR(S) : Karl Kaljura It is certified that error appears in the above-identified patent and that said Letters Patent is hereby corrected as shown below:

Claims

Column 8, line 40, claim 8:

after “wherein”, insert --in an--

Signed and Sealed this
Ninth Day of February, 2016

Michelle K. Lee

Michelle K. Lee
*Director of the United States Patent and Trademark Office*